US008887703B2

(12) United States Patent
Valencia et al.

(10) Patent No.: US 8,887,703 B2
(45) Date of Patent: Nov. 18, 2014

(54) INTEGRATED POSITIVE CRANKCASE VENTILATION VENT

(75) Inventors: Frank Acierno Valencia, Canton, MI (US); Timothy Gerald Taylor, Westland, MI (US); John William Robinson, Wixom, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 121 days.

(21) Appl. No.: 13/270,123

(22) Filed: Oct. 10, 2011

(65) Prior Publication Data

US 2013/0087128 A1 Apr. 11, 2013

(51) Int. Cl.
*F02B 25/06* (2006.01)

(52) U.S. Cl.
USPC ..... 123/572; 60/323; 60/313

(58) Field of Classification Search
USPC ..... 123/572–574, 41.86, 41, 82 R, 41.82 R; 60/313, 321, 323
See application file for complete search history.

(56) References Cited

U.S. PATENT DOCUMENTS

| | | | | |
|---|---|---|---|---|
| 3,263,402 | A | 8/1966 | Lindamood et al. | |
| 4,136,650 | A * | 1/1979 | Manookian, Jr. | 123/573 |
| 4,237,847 | A | 12/1980 | Baugh et al. | |
| 4,790,287 | A | 12/1988 | Sakurai et al. | |
| 4,947,812 | A * | 8/1990 | Inoue et al. | 123/193.2 |
| 5,190,005 | A | 3/1993 | Saito et al. | |
| 5,247,915 | A | 9/1993 | Sasada et al. | |
| 5,357,922 | A | 10/1994 | Han | |
| 6,070,562 | A | 6/2000 | Van Bezeij | |
| 6,513,506 | B1 * | 2/2003 | Ito et al. | 123/568.13 |
| 6,684,845 | B2 | 2/2004 | Cho | |
| 6,920,869 | B2 * | 7/2005 | Murata et al. | 123/572 |
| 7,367,294 | B2 | 5/2008 | Rozario et al. | |
| 7,419,554 | B2 | 9/2008 | Eriksson et al. | |
| 7,506,629 | B2 * | 3/2009 | Kawamura et al. | 123/195 C |
| 7,509,936 | B2 | 3/2009 | Weinzierl et al. | |
| 7,784,442 | B2 * | 8/2010 | Lester et al. | 123/193.5 |
| 8,347,865 | B2 * | 1/2013 | Valencia et al. | 123/574 |
| 2002/0020368 | A1 | 2/2002 | Fujimoto et al. | |
| 2005/0087154 | A1 | 4/2005 | Hayman et al. | |
| 2007/0137606 | A1 | 6/2007 | Takahashi et al. | |
| 2009/0041398 | A1 | 2/2009 | Tanaka et al. | |
| 2010/0050977 | A1 | 3/2010 | Park | |
| 2010/0077999 | A1 * | 4/2010 | Okada | 123/572 |
| 2010/0101514 | A1 | 4/2010 | Hirano et al. | |
| 2011/0067387 | A1 * | 3/2011 | Jacques et al. | 60/299 |

FOREIGN PATENT DOCUMENTS

| | | | |
|---|---|---|---|
| EP | 0274393 | B1 | 7/1988 |
| EP | 0291358 | B1 | 11/1988 |
| EP | 0368478 | B1 | 5/1990 |
| EP | 0411319 | B1 | 2/1991 |

(Continued)

OTHER PUBLICATIONS

Christopher K. Palazzolo et al., "Cylinder Block Assembly," U.S. Appl. No. 13/270,131, filed Oct. 10, 2011, 53 pages.

(Continued)

*Primary Examiner* — M. McMahon
(74) *Attorney, Agent, or Firm* — Julia Voutyras; Alleman Hall McCoy Russell & Tuttle LLP

(57) ABSTRACT

Systems and methods for ventilating engine crankcase gases are described. In one example, crankcase gases flow from a first cylinder bank to a second cylinder bank via tubes placed between exhaust gas manifold runners. The systems and method may improve crankcase gas ventilation.

19 Claims, 14 Drawing Sheets

(56) References Cited

FOREIGN PATENT DOCUMENTS

| | | | |
|---|---|---|---|
| EP | 0476506 | B1 | 3/1992 |
| EP | 0476706 | B1 | 3/1992 |
| EP | 0837236 | B1 | 4/1998 |
| EP | 1160438 | A2 | 12/2001 |
| EP | 1298295 | B1 | 4/2003 |
| EP | 1361355 | A1 | 11/2003 |
| EP | 1482135 | A2 | 12/2004 |
| EP | 2063085 | B1 | 5/2009 |
| GB | 712869 | | 8/1954 |
| JP | 5019543 | A | 1/1993 |
| JP | 5263653 | A | 10/1993 |
| JP | 5263654 | A | 10/1993 |
| JP | 5321760 | A | 12/1993 |
| JP | 8200154 | A | 8/1996 |
| JP | 9195870 | A | 7/1997 |
| JP | 10054298 | A | 2/1998 |
| JP | 10061485 | A | 3/1998 |
| JP | 10196451 | A | 7/1998 |
| JP | 10266892 | A | 10/1998 |
| JP | 2001317534 | A | 11/2001 |
| JP | 2007064081 | A | 3/2007 |
| JP | 2007239497 | A | 9/2007 |

OTHER PUBLICATIONS

Christopher K. Palazzolo et al., "Cylinder Block Assembly," U.S. Appl. No. 13/270,088, filed Oct. 10, 2011, 50 pages.

Christopher K. Palazzolo et al., "Cylinder Block," U.S. Appl. No. 13/270,098, filed Oct. 10. 2011, 47 pages.

Christopher K. Palazzolo et al., "Structural Frame," U.S. Appl. No. 13/270,100, filed Oct. 10, 2011, 46 pages.

Christopher K. Palazzolo et al., "Cylinder Block Assembly," U.S. Appl. No. 13/270,106, filed Oct. 10, 2011, 65 pages.

Christopher K. Palazzolo et al., "Cylinder Block Assembly," U.S. Appl. No. 13/270,110, filed Oct. 10, 2011, 64 pages.

* cited by examiner

INTEGRATED POSITIVE CRANKCASE VENTILATION VENT

BACKGROUND

Internal combustion engines may generate blow-by gases during operation. That is to say that gases generated in the combustion chamber may leak past the piston rings and into the crankcase. As a result, oil degradation as well as other types of engine degradation may occur when blow by gases are not vented from a sealed crankcase. Therefore, draft tubes extending from the crankcase to the bottom of the engine compartment were developed to vent the blow-by gas from the crankcase to the atmosphere. Draft tubes rely on the motion of the vehicle to generate a vacuum to generate blow-by gas flow from the crankcase to the atmosphere. However, draft tubes may release hydrocarbons to the atmosphere. Furthermore, vehicle motion is required to operate the draft tube, thereby decreasing the window of operation for the draft tubes. Moreover, draft tubes may also take on water in certain driving environments. As a result, engine degradation may occur.

To solve at least some of the aforementioned shortcomings of the draft tube, positive crankcase ventilation (PCV) systems have been developed. For example, U.S. Pat. No. 4,790,287 describes a crankcase ventilation system for an engine. Air is flowed through openings in a valley between opposing cylinders in a V configuration engine to a PCV valve that is in fluid communication with an engine air intake system. In this way, gas flow through the crankcase may be directed to the engine air intake system for combustion, thereby decreasing vehicle emissions. The crankcase ventilation system further includes an oil separator for separating oil from the air in the crankcase ventilation system. Thus, the air flowing out of the crankcase ventilation system may not be entrained with oil from the engine.

The Inventors have recognized several drawbacks with this type of positive crankcase ventilation system. Firstly, due to the geometric configuration of the inlet and outlet crankcase ventilation conduits, an airflow pattern may develop which may decrease the ability of the ventilation system to remove water vapor from the crankcase as well as reduce oil degradation. Specifically, air may not flow to certain areas of the crankcase such as locations in the front and rear of the crankcase, therefore oil degradation (e.g., oil gelling) may occur in the aforementioned locations.

SUMMARY

The inventors herein have developed an engine that overcomes at least some of the limitations of venting an engine crankcase. In one example, the engine comprises: an engine block; a cylinder head coupled to the engine block and including an integrated exhaust manifold with at least first and second exhaust gas runners; and a PCV vent positioned between the first and second exhaust gas runners and extending from a bottom of the cylinder head to a top of the cylinder head.

When a PCV vent is positioned between exhaust runners in an integrated exhaust manifold, the compactness of the engine may be increased. Moreover, when the PCV vent is positioned in this manner, an airflow pattern that is conducive to evenly distributing the gas flow in the crankcase as well as increasing the gas flow in the crankcase may be generated. As a result, the likelihood of oil degradation, such as oil gelling, may be reduced. Therefore, engine operation may be improved. In addition, the exhaust gas runners can provide heat to warm crankcase gases flowing through the vents so that condensation of water vapor in the PCV vent may be less likely.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE FIGURES

FIGS. 3-15 are drawn approximately to scale.

DETAILED DESCRIPTION

A positive crankcase ventilation (PCV) system having a PCV vent extending between exhaust gas runners included in an exhaust manifold that is integrated into a cylinder head is disclosed. The PCV vent may extend from a top of the cylinder head to a bottom of the cylinder head. The PCV vent may also extend through an external sidewall of the engine block and open into an outer portion of the crankcase. As a result, gases in the crankcase may flow in a pattern that increases flow distribution in the crankcase. Therefore, an increased amount of water and vapors may be removed from the crankcase. Further, oil degradation, such as oil gelling in the crankcase, oil pan, etc., may be reduced.

Figure 1:
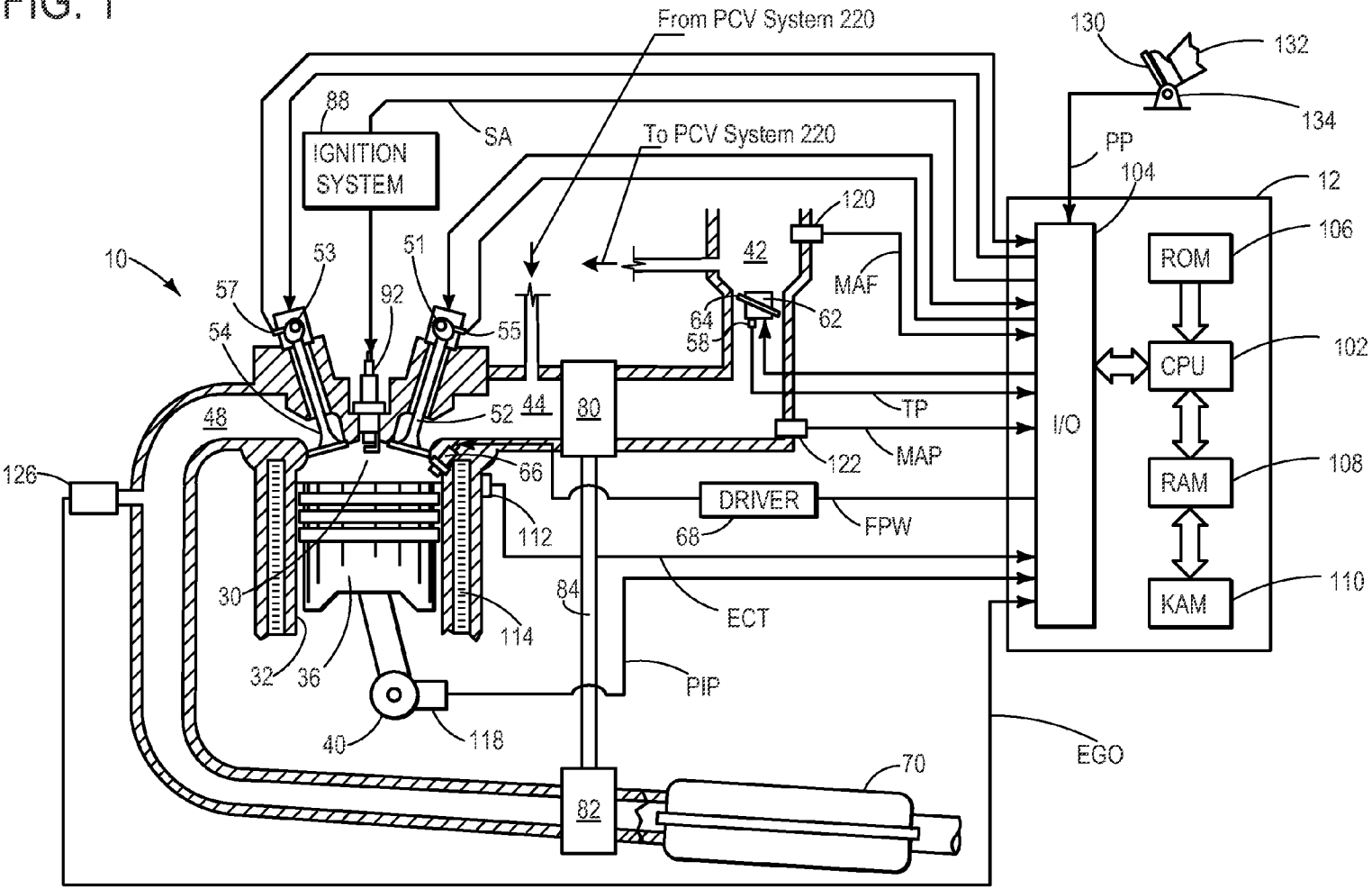
FIG. 1 shows a schematic depiction of an engine.

Referring to FIG. 1, internal combustion engine 10, comprising a plurality of cylinders, one cylinder of which is shown in FIG. 1, is controlled by electronic engine controller 12. Engine 10 includes cylinder 30 and cylinder walls 32 with piston 36 positioned therein and connected to crankshaft 40. Cylinder 30 may also be referred to as a combustion chamber. Cylinder 30 is shown communicating with intake manifold 44 and exhaust manifold 48 via respective intake valve 52 and exhaust valve 54. Although cylinder 30 is depicted as including a single intake and exhaust valve, it will be appreciated that in some examples cylinder 30 may include two or more intake valves and two or more exhaust valves. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Figure 2:
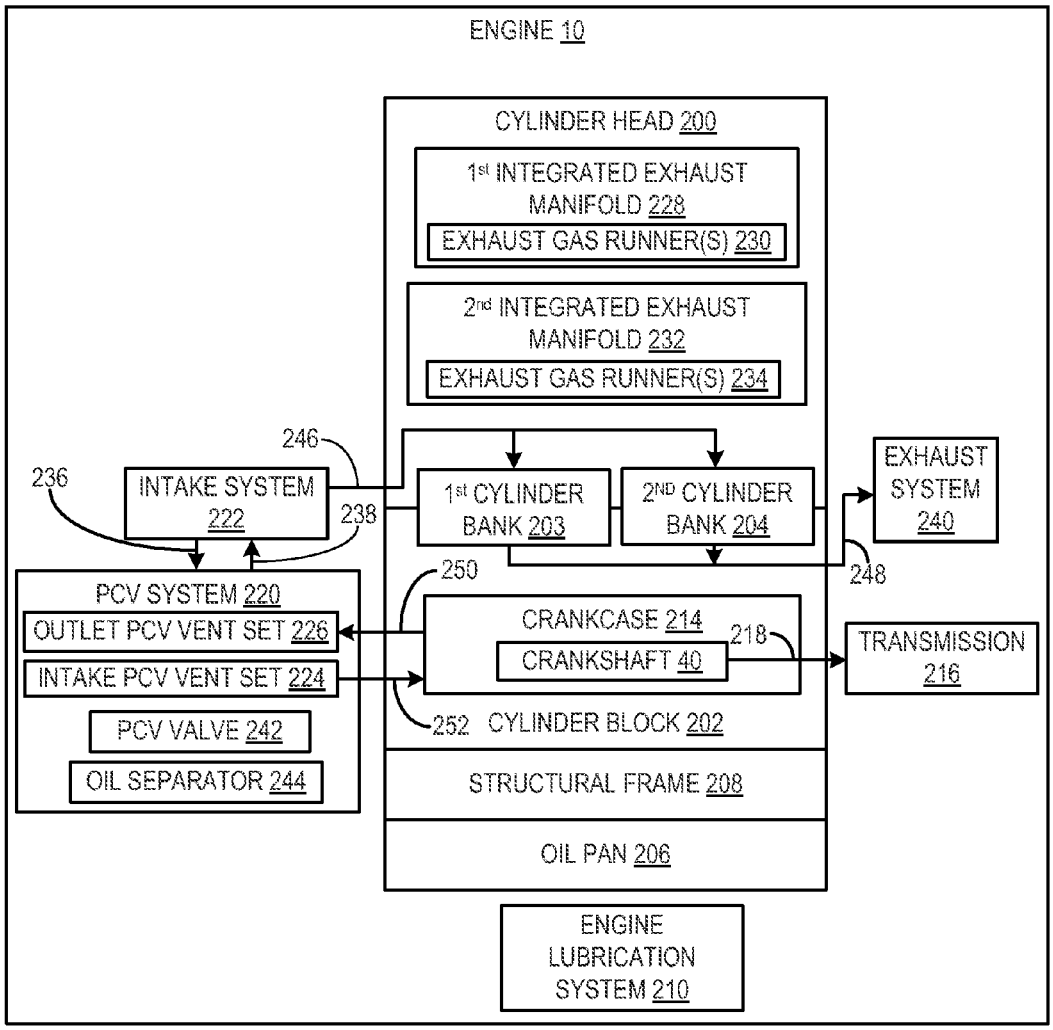
FIG. 2 shows another schematic depiction of the engine shown in FIG. 1.

A passage 236 is in fluid communication to intake manifold 44 and the PCV system 220, shown in FIG. 2 discussed in greater detail herein. Specifically, passage 236 may flow gas into the intake manifold 44. Additionally, passage 238 is in fluid communication with zip tube 42 and the PCV system 220, shown in FIG. 2. Passage 238 may receive air from the zip tube 42.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures. Additionally or alternatively a fuel injector may be positioned upstream of intake valve 52 and configured to inject fuel into the intake manifold, which is known to those skilled in the art as port injection.

Distributorless ignition system 88 provides an ignition spark to cylinder 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into cylinder 30 via intake manifold 44, and piston 36 moves to the bottom of the cylinder so as to increase the volume within cylinder 30. The position at which piston 36 is near the bottom of the cylinder and at the end of its stroke (e.g., when cylinder 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within cylinder 30. The point at which piston 36 is at the end of its stroke and closest to the cylinder head (e.g., when cylinder 30 is at its smallest volume) is typically referred to by those of skill in the art as top dead center (TDC). In a process hereinafter referred to as injection, fuel is introduced into the cylinder. In a process hereinafter referred to as ignition, the injected fuel is ignited by known ignition means such as spark plug 92 and/or via compression, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Engine 10 may further include a turbocharger having a compressor 80 positioned in intake manifold 44 coupled to a turbine 82 positioned in exhaust manifold 48. A driveshaft 84 may couple the compressor to the turbine. Thus, the turbocharger may include compressor 80, turbine 82, and driveshaft 84. Exhaust gases may be directed through the turbine, driving a rotor assembly which in turn rotates the driveshaft. In turn the driveshaft rotates an impeller included in the compressor configured to increase the density of the air delivered to cylinder 30. In this way, the power output of the engine may be increased. In other examples, the compressor may be mechanically driven and turbine 82 may not be included in the engine. Further, in other examples, engine 10 may be naturally aspirated.

FIG. 2 shows another schematic depiction of the engine 10, shown in FIG. 1. It will be appreciated that although the engine components in FIG. 1 are not shown in FIG. 2, they may be incorporated into the engine shown in FIG. 2. As shown, the engine 10 may include a cylinder head 200 coupled to a engine block 202 a first cylinder bank 203 and a second cylinder bank 204. Specifically in the depicted example, the engine 10 may include 6 cylinders and therefore each cylinder bank may include 3 cylinders. The cylinders may be arranged in a V-configuration in which cylinders in opposing banks are arranged at non-straight angles with respect to one another. However, in other examples the cylinders may not be divided into cylinder banks (e.g., the cylinders may be arranged in an inline configuration), the cylinders may be arranged in a different configuration (e.g., the cylinders in the separate banks may be horizontally opposed), and/or may include an alternate number of cylinders. Furthermore, the cylinders may be longitudinally offset and are discussed in greater detail herein with regard to FIGS. 3-15.

An oil pan 206 may be coupled to the structural frame 208. The oil pan 206 may be positioned vertically below the structural frame 208 which may be coupled to the engine block 202. An engine block assembly may include the engine block 202, the structural frame 208, and/or the oil pan 206. An exemplary attachment interface between the engine block 202 and the structural frame 208 is described in U.S. Provisional Patent No. 61/428,119 entitled "CYLINDER BLOCK ASSEMBLY" the contents of which are herein incorporated by reference. The oil pan 206 may receive oil from the engine. A lubrication system 210 may be coupled to the oil pan 206. The lubrication system 210 may include a pump disposed in the oil pan 206 as well as other components configured to deliver oil or other suitable lubricant to various engine components such as the cylinder banks (203 and 204), a crankshaft 40, etc.

The engine block 202 may also include the crankshaft 40 at least partially enclosed by a crankcase 214. In this way, the crankshaft may be housed via the crankcase 214. Bearing caps in the engine block 202 may provide support for the crankshaft 40. The crankcase may be substantially sealed from atmospheric pressure. The crankcase 214 may be bounded by the oil pan 206, a bottom portion of the engine block 202, and the structural frame 208. In other words, the periphery of the crankcase 214 may include portions of the oil pan 206, the engine block 202, and the structural frame 208. The crankshaft 40 may be rotatably coupled to a transmission 216. Arrow 218 depicts the transfer of rotation energy from the crankshaft 40 to the transmission 216. The transmission 216 may include a number of components for transmitting mechanical power, such as gears.

The crankcase 214 may be substantially sealed from the surrounding atmosphere. However, it will be appreciated that the blow-by gases generated during combustion may travel into the crankcase 214. Blow-by gases are gases that flow past the piston seal during combustion cycles in the engine. It will be appreciated that blow-by gases may include water vapor as well as other gases that may degrade various components in the crankcase. Therefore, a positive crankcase ventilation (PCV) system 220 may be in fluid communication with the crankcase 214. The PCV system may be configured to flow blow-by gases out of the crankcase into an intake system 222 which is in fluid communication with the cylinder banks (203 and 204) as well as to circulate intake air through the crankcase. It will be appreciated that portions of the PCV system 220 may be integrated into the cylinder head 200 and the engine block 202. This integration is shown in greater detail herein with regard to FIGS. 3-15. Moreover, the PCV system 220 enables water vapor as well as crankcase gases to flow out of the crankcase. In this way, the likelihood of oil degradation within the crankcase and oil pan as well as degradation to various components housed within the crankcase may be reduced, thereby increasing the longevity of the engine.

Specifically, the PCV system 220 may include a set of PCV intake vents 224 and a set of PCV outlet vents 226. Arrow 250 depicts the flow of gas from the crankcase 214 to the set of PCV outlet vents 226. Likewise, arrow 252 depicts the flow of intake air from the set of PCV intake vents 224 to the crankcase 214. In some examples, the set of PCV intake vents 224 may include a single PCV intake vent. However, in other examples the set of PCV intake vents 224 may include two or more PCV intake vents. Likewise, the set of PCV outlet vents 226 may include a single PCV outlet vent. However, in other examples the set of PCV outlet vents 226 may include two or more PCV outlet vents. In the example shown in FIGS. 3-15, the set of PCV outlet vents 226 includes two PCV outlet vents and the set of PCV intake vents 224 includes two PCV intake vents. Further still in other examples, the PCV system 220 may not include the set of PCV intake vents 224 and may solely rely on the blow-by gasses to generate gas flow through the PCV system 220.

The PCV intake vent(s) in the set of PCV intake vents 224 may extend through the cylinder head 200 adjacent to a first integrated exhaust manifold 228 integrated therein. The first integrated exhaust manifold 228 may include one or more exhaust gas runner(s) 232. The PCV outlet vent(s) in the set of PCV outlet vents 226 may extend through the cylinder head 200 adjacent to a second integrated exhaust manifold 232 including one or more exhaust gas runner(s) 234. However, in other examples the first and/or second integrated exhaust manifold (228 and 232) may include two or more exhaust gas runners. In such an example, a PCV intake vent, included in the set of PCV intake vents 224, may extend between a first and second exhaust gas runner included in the first integrated exhaust manifold 228 and an PCV outlet vent, included in the set of PCV outlet vents 226, may extend between a third and fourth exhaust gas runner included in the second integrated exhaust manifold 232.

Arrow 236 depicts the flow of gas (e.g., intake air) from the intake system 222 to the PCV system 220. Specifically, intake air may flow from the zip tube 42, shown in FIG. 1, in intake system 222 to the set of PCV intake vents 224. Conversely, arrow 238 depicts the flow of gas from the PCV system 220 to the intake system 222. Specifically, gas may be flowed from the set of PCV outlet vents 226 to the intake system 222 at a location downstream of the throttle 62 and/or compressor 80 shown in FIG. 1. In this way, gas may be circulated through the crankcase via the PCV system 220. It will be appreciated that the flow pattern generated by the arrangement of the sets of PCV vents may be conducive to increasing the amount of airflow through the crankcase as well as more evenly distributing the airflow around the crankcase when compared to other PCV system which route PCV vents through central locations in the engine block and cylinder head. As a result oil degradation, such as oil gelling, may be reduced, thereby improving engine operation and longevity. Further, the locations of PCV vents may reduce condensation of water vapor in the engine by heating gases flowing through the PCV vents.

The intake system 222 may be configured to supply the cylinder in the cylinder banks (203 and 204) with intake air as well as other gases for combustion. The intake system 222 may include intake manifold 44, zip tube 42, throttle 62, intake valve 52, and compressor 80, shown in FIG. 1. An exhaust system 240 may be configured to receive exhaust gases from cylinders in the cylinder banks (203 and 204) and flow the gases into the surrounding environment. The exhaust system 240 may include exhaust valve 54, exhaust manifold 48, turbine 82, and emission control device 70, shown in FIG. 1. The exhaust system 240 may include the first and second integrated exhaust manifolds (228 and 232). Arrow 246 represents the flow of intake air into the cylinder banks 203 and 204 from the intake system 222. Likewise, arrow 248 represents the flow of exhaust gases from the cylinder banks 203 and 204 to the exhaust system 240.

The PCV system 220 may further include a PCV valve 242 configured to control the flow of intake air into the crankcase 214 from the intake system 222 and/or gas from the crankcase 214 into the intake system 222. The PCV system 220 may also include an oil separator 244 configured to remove oil from the gas flowing from the crankcase to the intake system 222. The oil separator 244 may be coupled to the set of PCV outlet vents 226. However, in other examples, the PCV system 220 may not include the oil separator 244. Although FIG. 2 shows the PCV system 220 external to other components in the engine, it will be appreciated that various parts in the PCV system 220 may be integrated into various engine components such as the cylinder head and the engine block, discussed in greater detail herein with regard to FIGS. 3-15.

FIGS. 3-15 show an example engine 10 that includes PCV system 220 having a routing arrangement that generates a flow pattern conducive to increasing the airflow in the crankcase 214 as well as more evenly distributing the airflow through the crankcase when compared to PCV systems that route PCV vents through the center of the cylinder head and engine block. By increasing the airflow and flow distribution in the crankcase 214, the amount of water vapor as well as other gases in the crankcase 214 may be reduced. Specifically, PCV vents may be routed through a portion of the cylinder head 200 between exhaust runners of the integrated exhaust manifolds and through an exterior sidewall of the engine block 202. In this way, gas may be flowed to or from the crankcase near the lateral periphery as opposed to through the central valley of the engine. Coordinate axes (i.e., the longitudinal axis, the lateral axis, and/or the vertical axis) have been added to FIGS. 3-15 for reference. However, it will be appreciated that the engine 10 may have a number of different orientations when placed in a vehicle.

Figure 3:
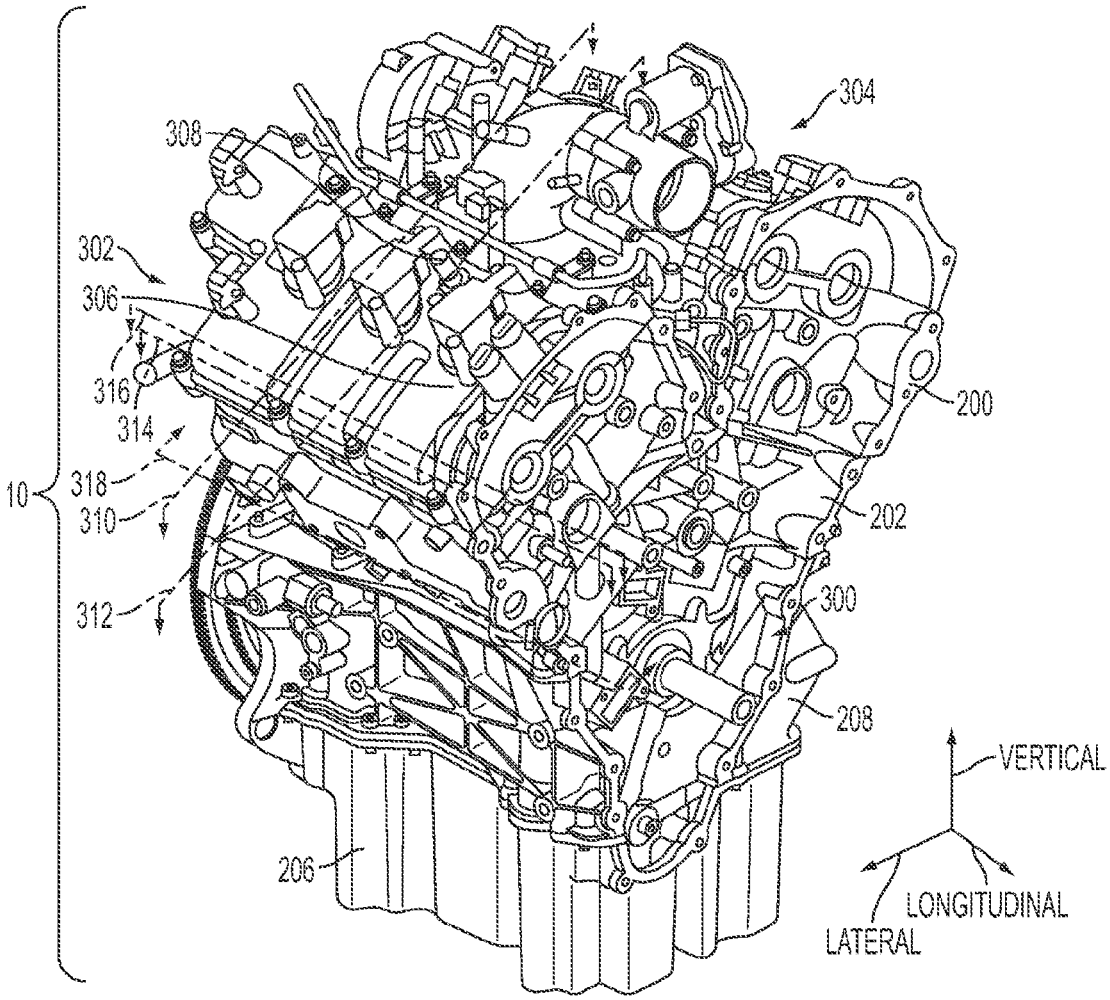
FIG. 3 shows a perspective view of an example engine including a positive crankcase ventilation (PCV) system, shown in FIG. 2.

FIG. 3 shows a perspective view of engine 10. The oil pan 206 is shown coupled to the structural frame 208 which is coupled to the engine block 202. Additionally, the cylinder head 200 is coupled to the engine block 202. It will be appreciated that an engine cover (not shown) may be coupled to a front portion 300 of the engine 10, to substantially seal the engine 10. The engine is in a V configuration in which two opposing cylinders are arranged at a non-straight angle, discussed in greater detail herein with regard to FIG. 4. The first cylinder bank 403, shown in FIG. 2, may be positioned on a first side 302 of the engine 10 and the second cylinder bank 204, shown in FIG. 2, may be positioned on a second side 304 of the engine 10.

A first cam cover 306 may seal a portion of the engine surrounding the cams (not shown) corresponding to the first cylinder bank 203. The first cam cover 306 may partially define a boundary of a first cam chamber 404, shown in FIG. 4. Likewise, a second cam cover 900, shown in FIG. 9, corresponding to the second cylinder bank may be disposed on the other side of the engine 10. Each cylinder bank may have an integrated exhaust manifold in fluid communication with engine cylinders, as previously discussed. The first cam cover 306 may include an intake port 308. The intake port 308 may be in fluidic communication with the intake system 222, shown in FIG. 2. Specifically, the intake port 308 may be in fluid communication with the zip tube 42 in the intake system 222 positioned upstream of throttle 62 via a suitable conduit (not shown). In this way, intake air may be flowed from the intake system 222 to the first cam chamber 404, shown in FIG. 4. In some examples, the intake port 308 may include a filter (not shown).

Figure 4:
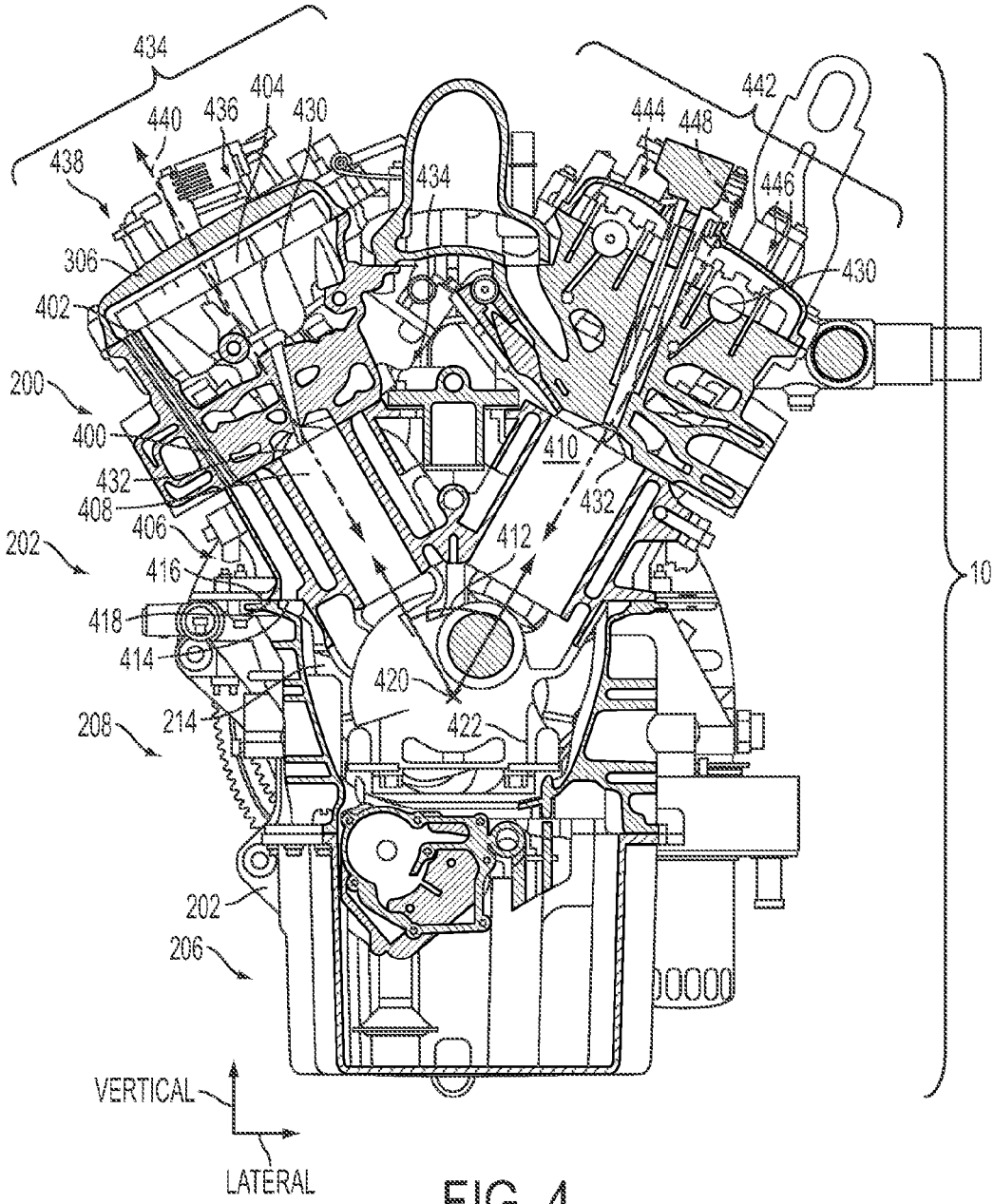
FIG. 4 shows a cross-sectional view of a first PCV intake vent included in the PCV system, shown in FIG. 2.

Cutting plane 310 defines the cross-section shown in FIG. 4. Cutting plane 312 defines the cross-section shown in FIG. 5. Cutting plane 316 defines the cross-section shown in FIG. 6. Cutting plane 314 defines the cross-section shown in FIG. 7 and cutting plane 318 defines the cross-section shown in FIG. 8.

FIG. 4 shows a cross-sectional view of a first PCV intake vent 400 included in the set of PCV intake vents 224, shown in FIG. 2. The first PCV intake vent 400 extends in a partially vertical direction through the engine 10. As shown, the first PCV intake vent 400 includes an inlet 402 opening into the first cam chamber 404. It will be appreciated that the first cam chamber 404 may be substantially sealed aside from intake port 308 and the first PCV intake vent 400 and a second PCV intake vent 500, shown in FIG. 5.

Figure 7:
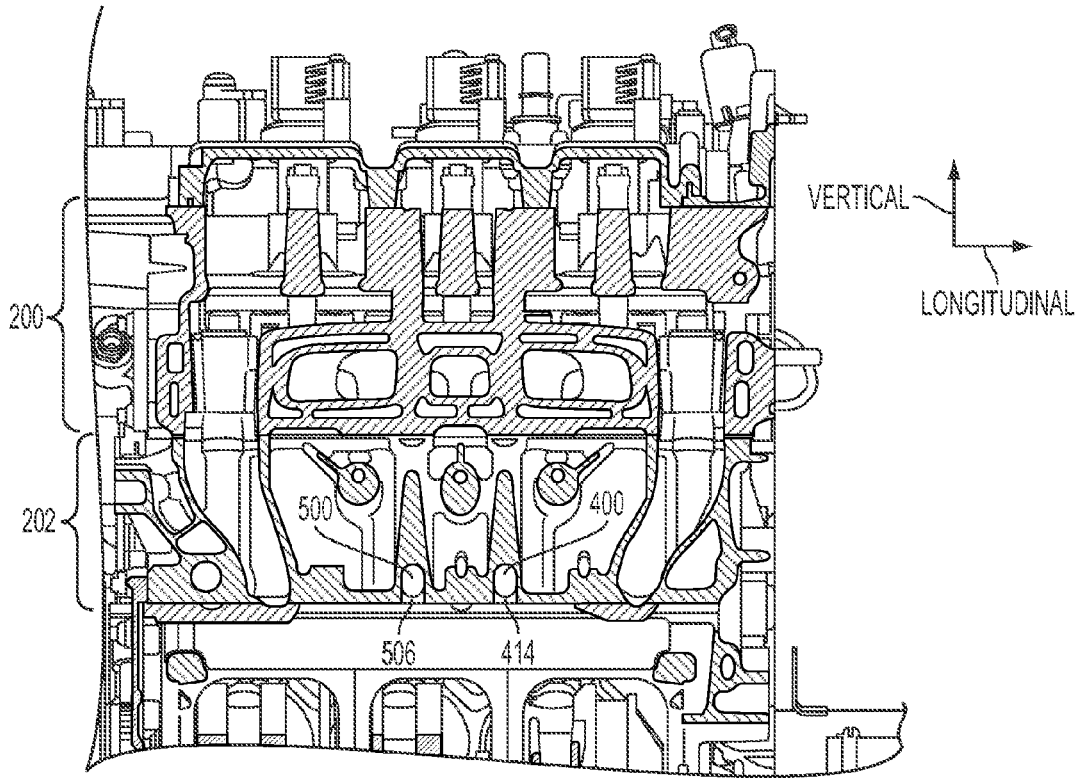
Figure 8:
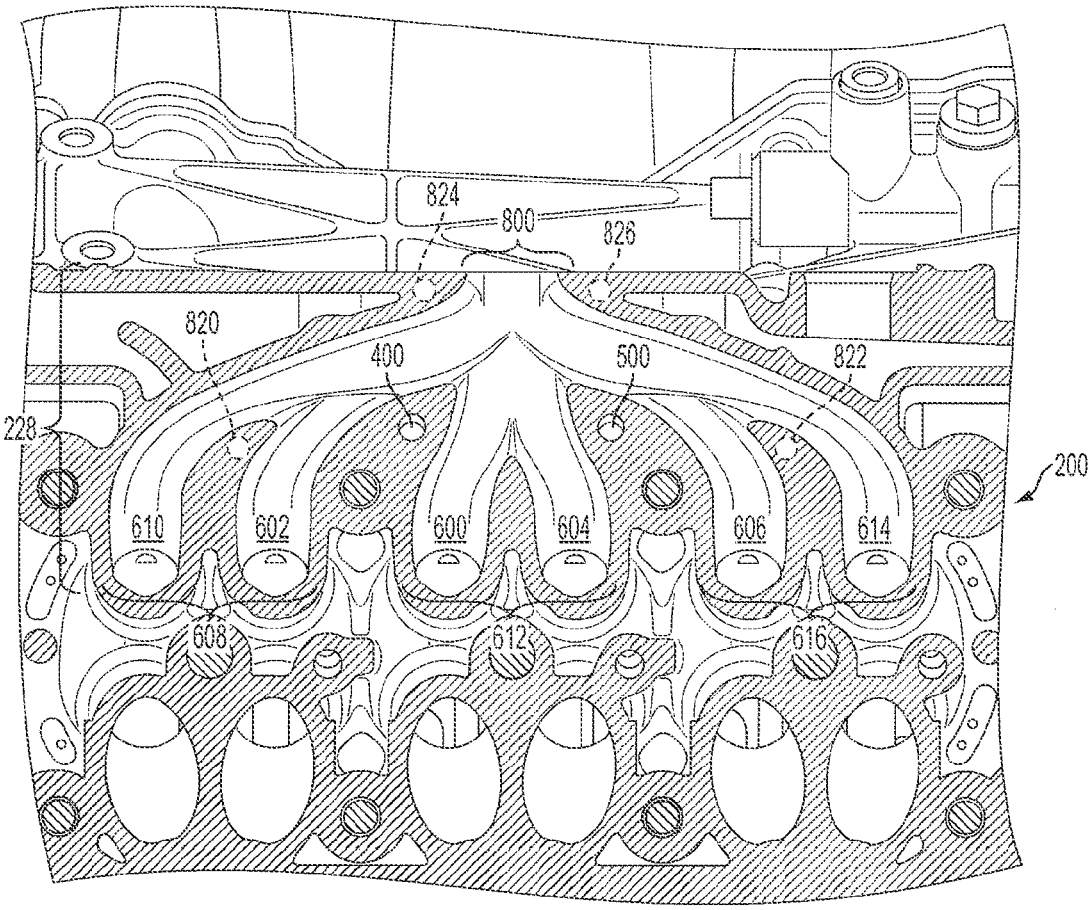
FIG. 8 shows a cross-sectional view of the first and second PCV intake vents and a first integrated exhaust manifold included in the PCV system and the engine, shown in FIG. 2.

The first PCV intake vent 400 may extend through the cylinder head 200 in a region adjacent to the first integrated exhaust manifold 228, shown in greater detail herein with regard to FIGS. 7 and 8. Specifically, the first PCV intake vent 400 may extend from a top 430 of the cylinder head 200 to a bottom 432 of the cylinder head 200. The first PCV intake vent 400 may also extend through the engine block 202. Specifically, the first PCV outlet vent 400 extends through a first exterior sidewall 406 of the engine block 202 and is adjacent to a cylinder 408. Furthermore, the first exterior sidewall 406 may extend from a structural frame engaging surface 416 to a crankshaft support (not shown) included in the engine block 202. Cylinder 408 may be included in the first cylinder bank 403, shown in FIG. 2. On the other hand, cylinder 410 may be included in the second cylinder bank 204, shown in FIG. 2. As shown, the axes of cylinders 408 and 410 may be arranged at a non-straight angle 412 with respect to one another. In this way, the cylinders in opposing cylinder banks may be arranged in a V-configuration. However, alternate cylinder arrangements may be used in other examples.

The first PCV intake vent 400 further includes an outlet 414 opening into the crankcase 214. In this way, gas such as blow-by gas may be flowed from the intake system 222, shown in FIG. 2, into the first cam chamber 404, through the first PCV intake vent 400, and into the crankcase 214.

Additionally, the engine block 202 may include the structural frame engaging surface 416. The structural frame engine surface may be configured to attach to a engine block engaging surface 418 in a structural frame 208 coupled to the engine block 202. The structural frame engaging surface 416 and the engine block engaging surface 418 may be coupled at a location above a centerline 420 of a crankshaft support 422 included in the engine block 202. U.S. Provisional Patent Application No. 61/428,119 entitled "CYLINDER BLOCK ASSEMBLY" discloses an exemplary engine block and structural frame engaging surfaces.

A first portion 434 of the engine 10 including the first cylinder bank 203, shown in FIG. 2, may be divided into an intake side 436 and an exhaust side 438. The boundary dividing the intake side 436 and the exhaust side 438 of the first portion 434 is a plane 440 extending through the centerlines of the cylinders (e.g., cylinder 408 shown in FIG. 4 and cylinder 504 shown in FIG. 5) in the first cylinder bank 203. In another example, the exhaust side and the intake side of the cylinder head may be separated via a centerline of a row of combustion chambers of the cylinder head. It will be appreciated that the plane 440 extends into and out of the page. The first PCV intake vent 400 may be positioned in the exhaust side 438. Further, it will be appreciated that both the cylinder head 200 and engine block 202 may each have an exhaust side and an intake side corresponding to the intake and exhaust sides (436 and 438) of the first portion 434 of the engine 10.

Likewise, a second portion 442 of the cylinder head 200 including the second cylinder bank 204, shown in FIG. 2, may be divided into an intake side 444 and an exhaust side 446. The boundary dividing the intake side 444 and the exhaust side 446 of the second portion 442 is a plane 448 extending through the centerlines of the cylinders in the second cylinder bank 204 such as cylinder 410 and cylinder 508 shown in FIG. 5. Alternatively, the boundary separating the intake and exhaust sides of the cylinder head is a centerline of a row of combustion chambers in the cylinder head. It will be appreciated that the plane 448 extends into and out of the page.

Further in other examples, engine 10 may include a single cylinder bank. Therefore, the engine 10 may include a single exhaust side and intake side.

Figure 5:
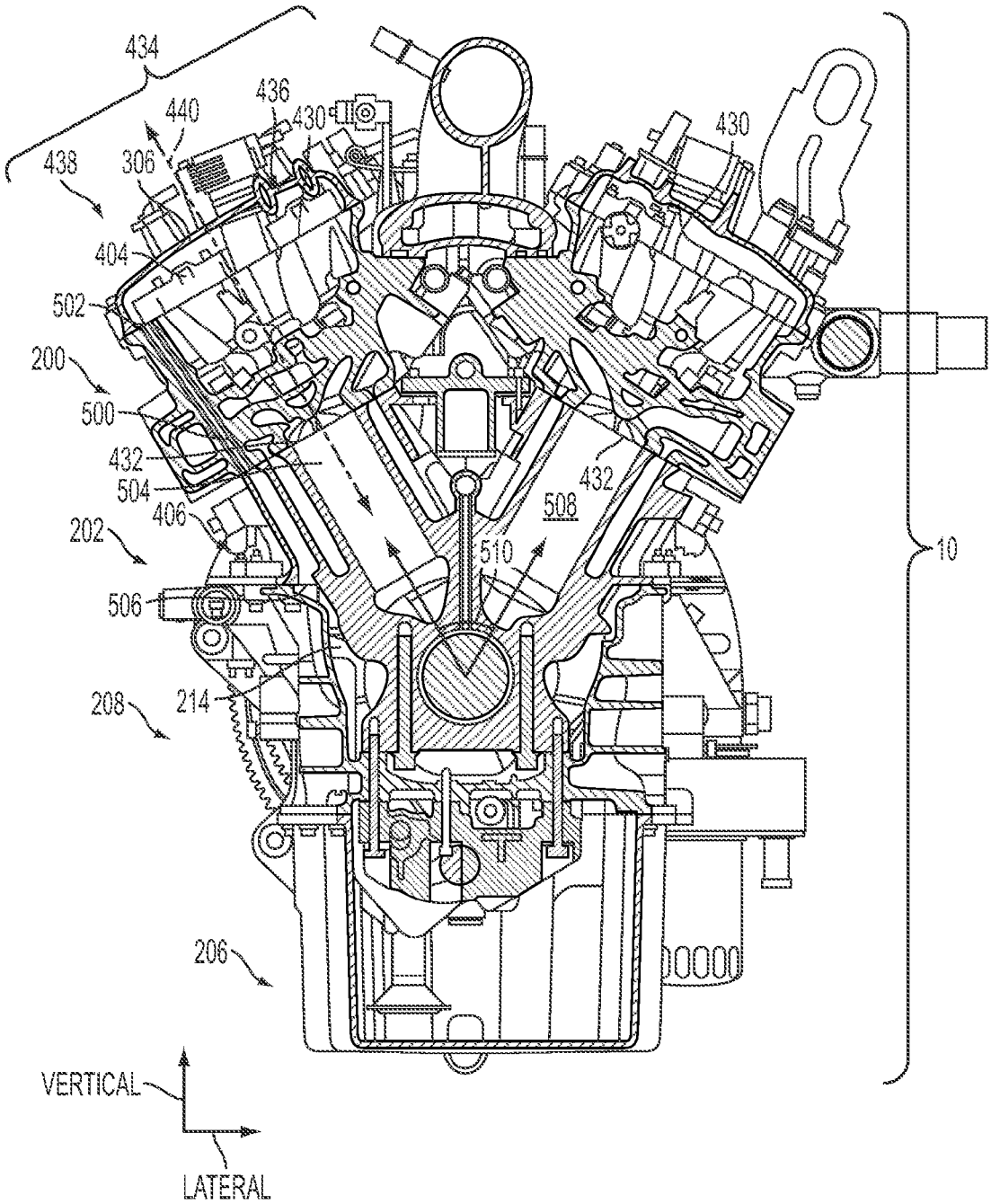
FIG. 5 shows a cross-sectional view of a second PCV intake vent included in the PCV system shown in FIG. 2.

FIG. 5 shows a cross-sectional view of a second PCV intake vent 500 included in the set of PCV intake vents 224. The second PCV intake vent 500 extends in a partially vertical direction through the engine 10. The second PCV intake vent 500 may be positioned on the exhaust side 438 of the first portion 434 of engine 10.

As shown, the second PCV intake vent 500 includes an inlet 502 opening into the first cam chamber 404 a portion of the periphery of the chamber defined by the first cam cover 306. The second PCV intake vent 500 may be positioned in the exhaust side 438 of the first portion 434 of engine 10. Furthermore, the second PCV intake vent 500 may extend through the cylinder head 200 in a region adjacent to the first integrated exhaust manifold 228, shown in FIG. 2 and FIG. 8 and discussed greater detail herein. The second PCV intake vent 500 may also extend through the engine block 202. As shown, the second PCV intake vent 500 is adjacent to the exterior sidewall 406 of the engine block 202 and is adjacent to a cylinder 504. Further, the PCV intake vent is positioned between exhaust manifold runners. Cylinder 504 may be included in the first cylinder bank 203, shown in FIG. 2. The second PCV intake vent 500 may further include an outlet 506 opening into the crankcase 214. In this way, intake air from the intake system 222, shown in FIG. 2, may be flowed into the crankcase 214. Specifically, air may be flowed from zip tube 42, shown in FIG. 1, to intake port 308, shown in FIG. 3, into the first cam chamber 404, shown in FIG. 5, through the second PCV intake vent 500 shown in FIG. 5, and into the crankcase 214, shown in FIG. 5. A cylinder 508 included in the second cylinder bank 204, shown in FIG. 2, is also shown in FIG. 5. It will be appreciated that the second cylinder 508 is arranged at a non-straight angle 510 with respect to the cylinder 504.

It will be appreciated that the first and second PCV intake vents (400 and 500) may generate a flow pattern in the crankcase that is conducive to removing water vapor as well as other gases from a greater portion of the crankcase than a PCV system which routes PCV intake vents through the valley between the cylinder banks in an engine having the cylinders arranged in a V-configuration.

Figure 6:
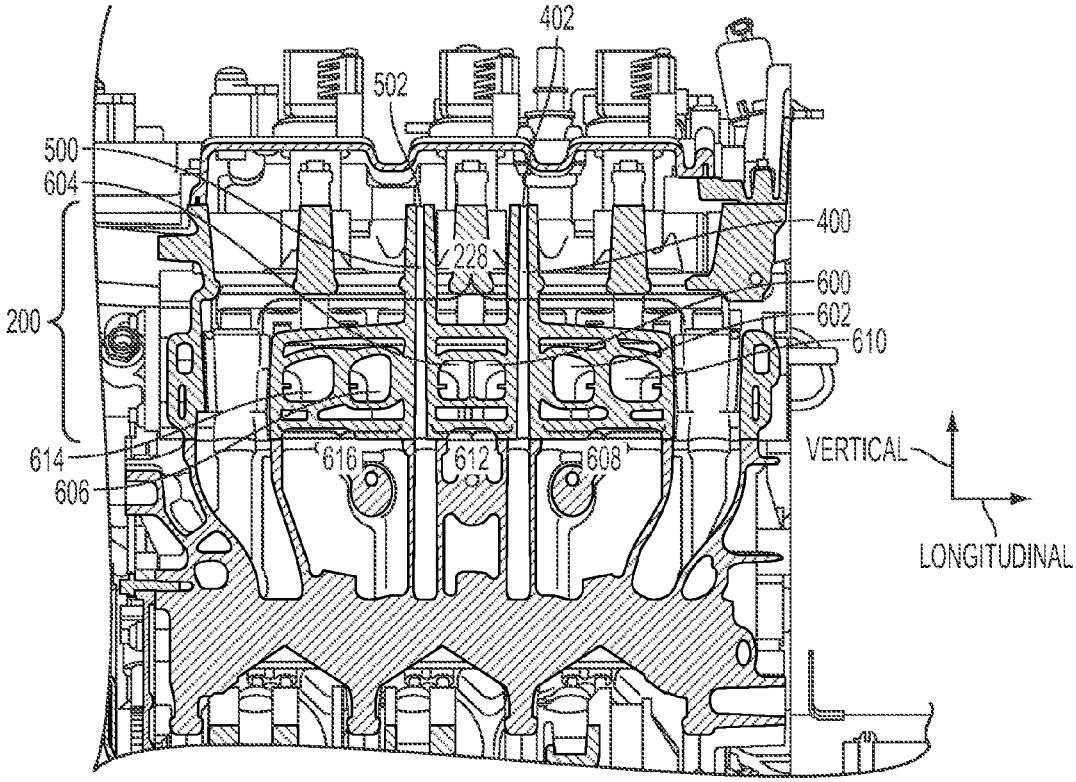
FIGS. 6 and 7 show cross-sectional views of the first and second PCV intake vents included in the PCV system, shown in FIG. 2.

FIGS. 6 and 7 show another cross-sectional view of the first and second PCV intake vents (400 and 500) included in the set of PCV intake vents 224, shown in FIG. 2. As shown, in FIG. 6 the first PCV intake vent 400 may extend through the cylinder head 200 between a first exhaust gas runner 600 and a second exhaust gas runner 602. Likewise, the second PCV vent may extent through the cylinder head 200 between a third exhaust gas runner 604 and a fourth exhaust gas runner 606. Exhaust gas runner 602 may be included in an outer set of exhaust gas runners 608 further including exhaust gas runner 610. Likewise, exhaust gas runner 600 and 604 may be included in an inner set of exhaust gas runners 612. Furthermore, exhaust gas runner 606 and 614 may be included in another set of outer exhaust gas runner 616.

It will be appreciated that when the PCV intake vents (400 and 500) are routed adjacent to exhaust gas runners (600, 602, 604, and 606) in the first integrated exhaust manifold 228 may provide cooling to the first integrated exhaust manifold 228. As a result, thermal degradation of the first integrated exhaust manifold 228 as well as components downstream of the first integrated exhaust manifold in the exhaust system may be reduced. Furthermore, it will be appreciated that when the first and second PCV intake vents (400 and 500) are routed through the cylinder head 200, and specifically between exhaust gas runners in the first integrated exhaust manifold 228, the compactness of the engine may be increased when compared to other engines that externally route PCV vents through the cylinder head and/or engine block. Moreover, the assembly process is simplified when the PCV vents are routed through the cylinder head adjacent to the integrated exhaust manifold. As a result the cost of the engine may be reduced.

As shown, the inlets 402 and 502 to the first and second PCV intake vents (400 and 500) are depicted in FIG. 6. The outlets (414 and 506) to the first and second PCV intake vents (400 and 500) are depicted in FIG. 7. It will be appreciated that the outlets (414 and 506) may be laterally offset from the inlets (402 and 502). However in other examples other configurations are possible.

FIG. 8 shows another cross-section view of the of the first and second PCV intake vents (400 and 500) included in the set of PCV intake vents 224 as well as the first integrated exhaust manifold 228. As previously discussed, the first and second PCV intake vents (400 and 500) each include an outlet, 414 and 506 respectively shown in FIGS. 4 and 5, opening into the crankcase 214.

The outer sets of exhaust gas runners (616 and 608) are depicted in FIG. 8. The outer set of exhaust gas runner 616 includes exhaust gas runners 606 and 614. The outer set of exhaust gas runners 608 includes exhaust gas runners 602 and 610. The inner set of exhaust gas runners 612 is also shown, the inner set of exhaust gas runner 612 including exhaust gas runners 600 and 604. Each set of exhaust gas runners if fluidly coupled to a separate cylinder. Specifically, each exhaust gas runner included in a set may be coupled to a separate exhaust valve in a cylinder. Thus, each cylinder may include two exhaust valves. However, other configurations are possible in other examples. For example, in another example each set of may include a single exhaust gas runner or more than two exhaust gas runners.

As shown, the first PCV intake vent 400 extends between the exhaust gas runner 602 and the exhaust gas runner 600. In this way, the first PCV intake vent 400 extends between a first exhaust gas runner fluidly coupled to a first cylinder and a second exhaust gas runner fluidly coupled to a second cylinder. However, in other examples, the first PCV intake vent 400 may extend between two exhaust gas runners fluidly coupled to the same cylinder. Additionally, the second PCV intake vent 500 extends between the exhaust gas runner 604 and the exhaust gas runner 606. In this way, the second PCV intake vent 500 extends between a third exhaust gas runner fluidly coupled to the second cylinder and a fourth exhaust gas runner fluidly coupled to a third cylinder. However, in other examples, the second PCV intake vent 500 may extend between two exhaust gas runners fluidly coupled to the same cylinder.

The inner and outer sets of exhaust gas runners (608, 612, and 616) may converge at a collector 800 included in the first integrated exhaust manifold 228. The collector 800 may be fluidly coupled to the exhaust system 240, shown in FIG. 2. For example, the collector 800 may be coupled to an exhaust conduit, a turbine of a turbocharger, etc.

Furthermore, the first and second PCV intake vents (400 and 500) are adjacent to the collector 800. In this way, cooling through the flow of gas through the PCV intake vents may be provided to the collector 800. Further, the likelihood of thermal degradation of the first integrated exhaust manifold and specifically the collector 800 may be reduced. As a result, the longevity of the engine 10 may be increased.

The PCV intake vents (400 and 500) may provide cooling to the first integrated exhaust manifold 228 via the transfer of heat from the exhaust manifold to the air in the PCV vents during certain operating conditions. Thus, heat may be removed from the first integrated exhaust manifold 228 and the cylinder head 200 via the PCV intake vents (400 and 500). As a result, the likelihood of thermal degradation of the cylinder head 200 and the first integrated exhaust manifold 228 may be reduced. Moreover, the heat transferred to the PCV intake vents (400 and 500) can reduce condensation in the PCV vents.

In other examples, additional or alternate PCV intake vents may be included in the engine 10. For example, an PCV intake vent 820 may be positioned between exhaust gas runners (602 and 610) and/or a PCV intake vent 822 may be positioned between exhaust gas runner (606 and 614). Furthermore, PCV intake vents 824 and/or 826 may be positioned near the periphery of the cylinder head adjacent to the collector 800. The PCV intake vents 820, 822, 824, and/or 826 may extend from the top 430 of the cylinder head 200 to the bottom 432 of the cylinder head 200 and through the engine block 202 opening into crankcase 214, shown in FIG. 4. The PCV intake vents 820, 822, 824, and/or 826 may also open into the first cam chamber 404, shown in FIG. 4.

Figure 9:
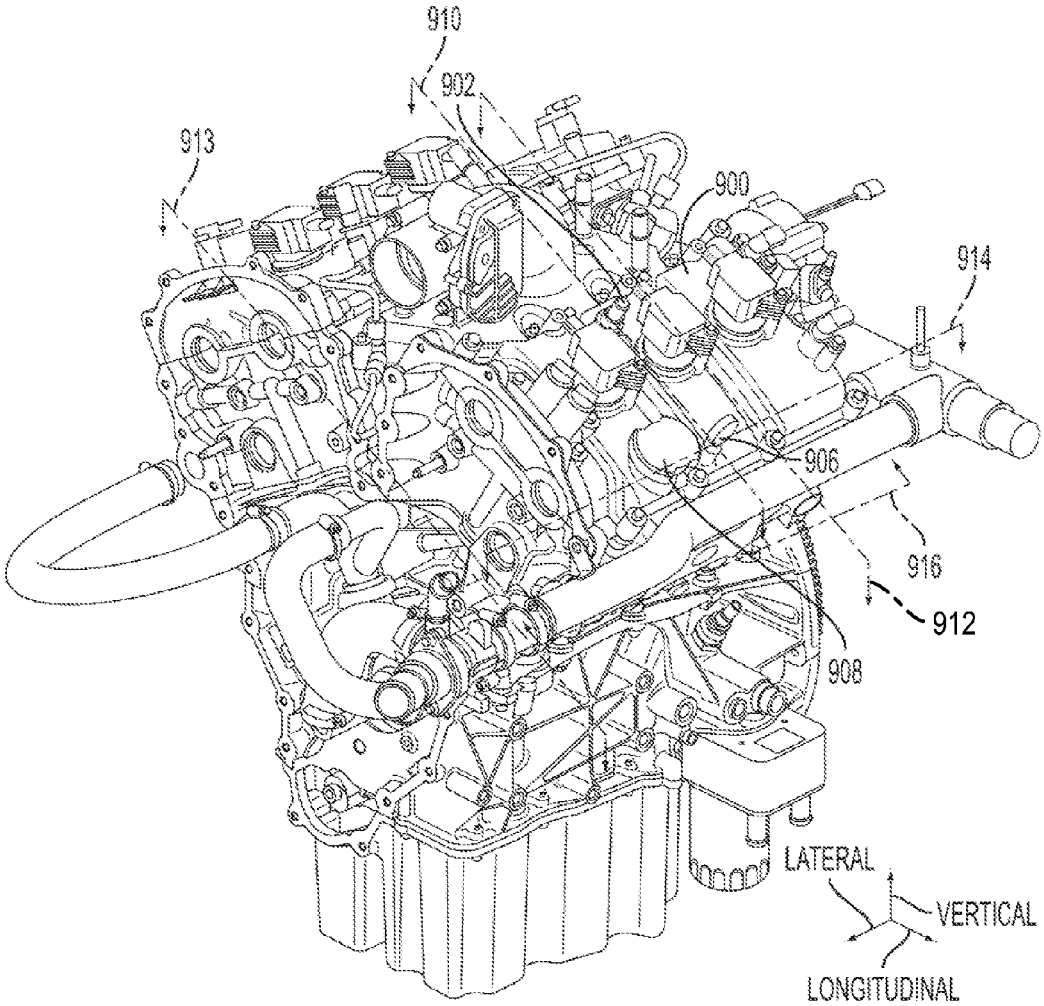
FIG. 9 shows another perspective view of the example engine including a positive crankcase ventilation (PCV) system, shown in FIG. 2.

FIG. 9 shows another perspective view of the engine 10. A second cam cover 900 is shown. The second cam cover 900 includes an outlet port 902. The outlet port 902 may open into a second cam chamber 1006, shown in FIG. 10. Continuing with FIG. 9, the outlet port 902 may be in fluidic communication with the intake system 222, shown in FIG. 2. Specifically, the outlet port 902 may be fluidly coupled to the zip tube 42, shown in FIG. 1, upstream of throttle 62, shown in FIG. 1.

The second cam cover 900 may further include a dipstick 906, inserted therein. The dipstick 906 may extend through a first PCV outlet vent 1000, shown in FIG. 10, traversing the cylinder head 200 and the engine block 202. The second cam cover 900 may also include an oil cap 908 configured to enable the vehicle operator to add oil to the engine 10.

Figure 10:
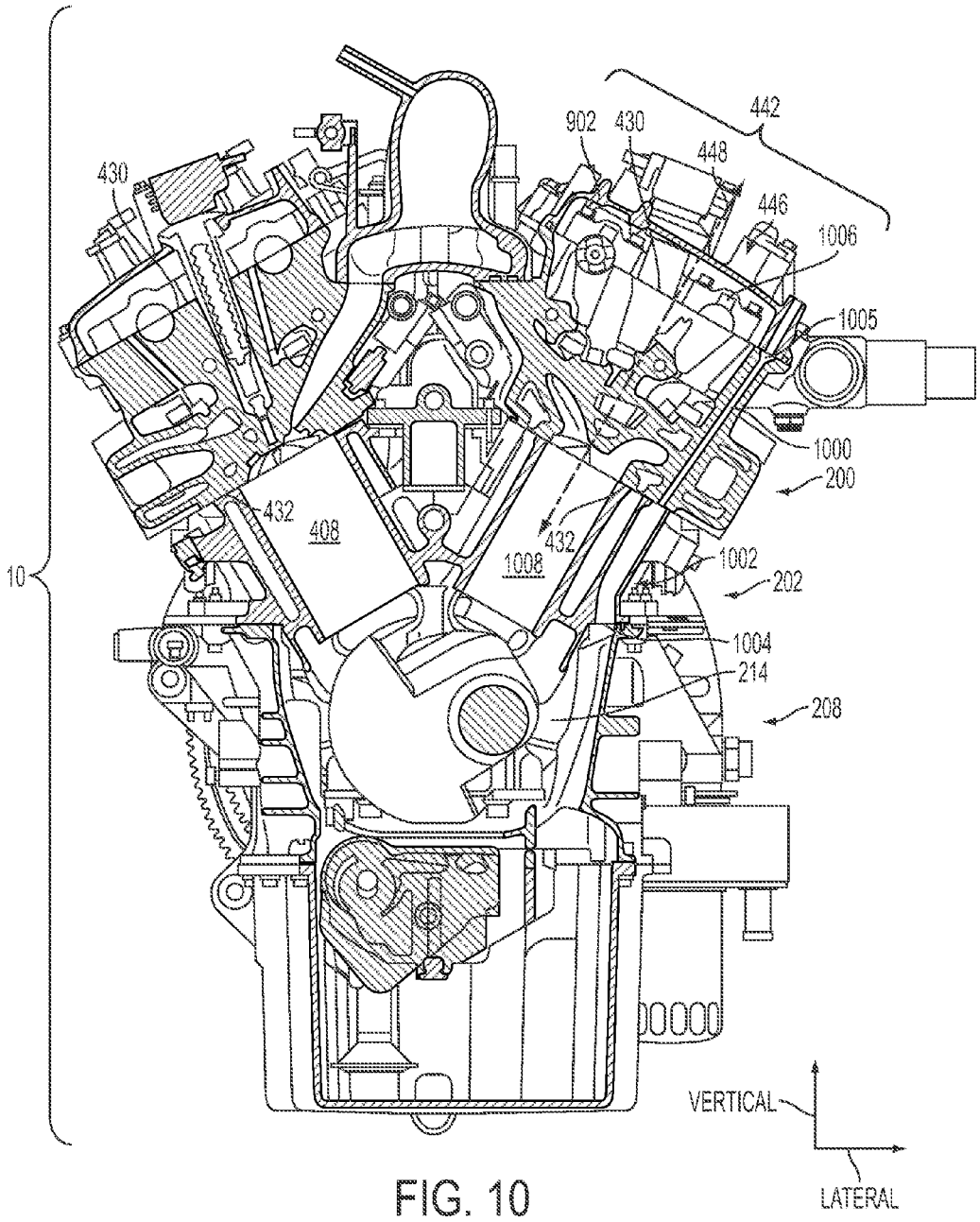
FIG. 10 shows a cross-sectional view of a first PCV outlet vent included in the PCV system, shown in FIG. 2.

Cutting plane 910 defines the cross-section shown in FIG. 10. Cutting plane 912 defines the cross-section shown in FIG. 11. Cutting plane 914 defines the cross-section shown in FIG. 12. Cutting plane 913 defines the cross-section shown in FIG. 13.

FIG. 10 shows a cross-sectional view of a first PCV outlet vent 1000 included in the set of PCV outlet vents 226, shown in FIG. 2. It will be appreciated that the dipstick 906 may at least partially extend into, as well as substantially seal a top portion of the first PCV outlet vent 1000. It will be appreciated that the dipstick does not inhibit gas flow through the first PCV outlet vent 1000. The first PCV outlet vent 1000 is positioned on the outlet side 446 of the second portion 442, corresponding to the second cylinder bank 204 shown in FIG. 2, of engine 10.

As shown, the first PCV outlet vent 1000 extends through the cylinder head 200 from the top 430 to the bottom 432 and through a second engine block exterior sidewall 1002. The first PCV outlet vent 1000 includes an inlet 1004 opening into the crankcase 214 and an outlet 1005 opening into a second cam chamber 1006. The periphery of the second cam chamber 1006 is at least partially defined by the second cam cover 900. FIG. 10 also shows the cylinder 408 included in the first cylinder bank 203 and a cylinder 1008 included in the second cylinder bank 204.

Figure 11:
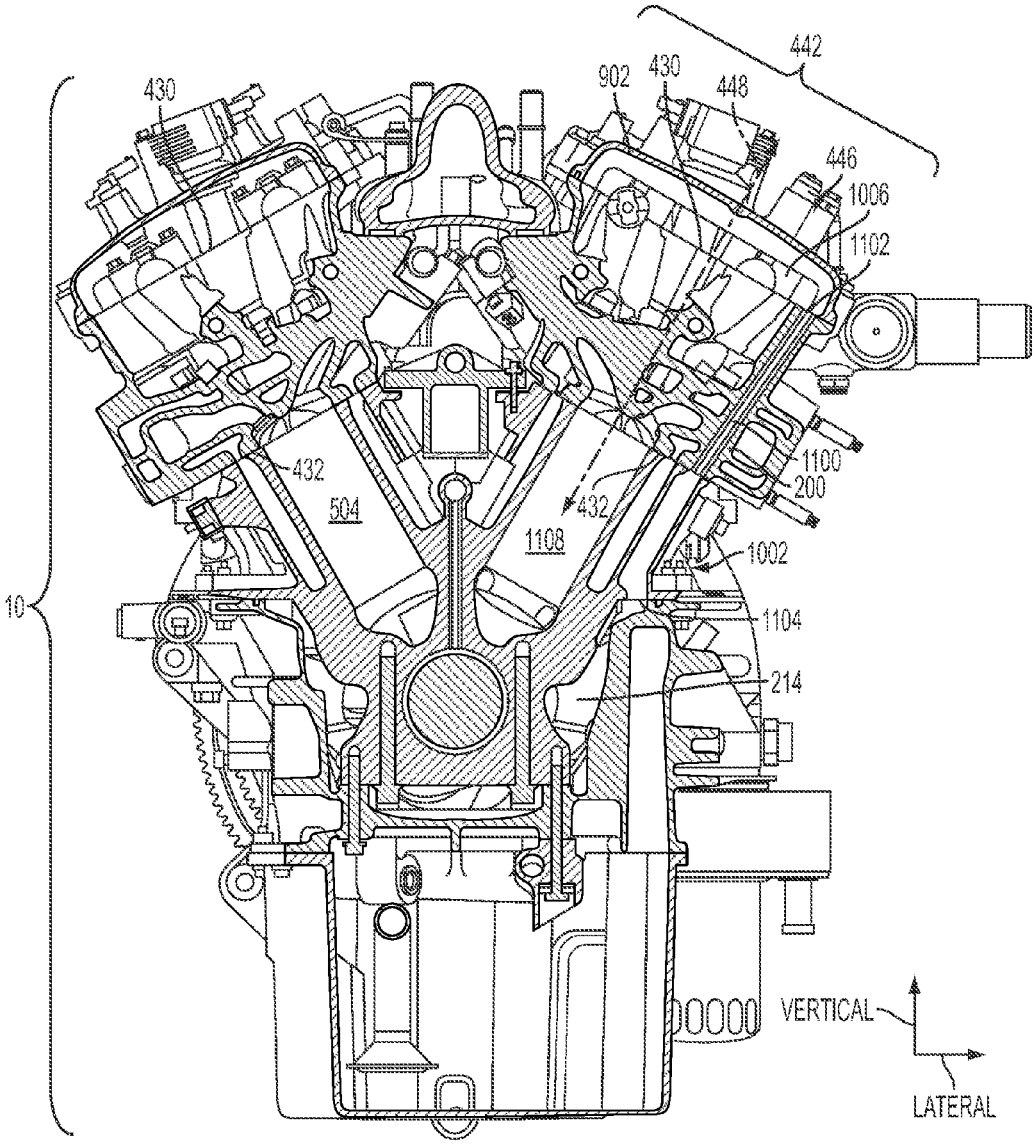
FIG. 11 shows a cross-sectional view of a second PCV outlet vent included in the PCV system, shown in FIG. 2.

FIG. 11 shows a cross-sectional view of a second PCV outlet vent 1100 included in the set of PCV outlet vents 226, shown in FIG. 2. In this example, the set of PCV outlet vents 226 includes two PCV outlet vents (1000 and 1100). However, in other examples the number of PCV vents included in the set of PCV outlet vents may be altered. The second PCV outlet vent 1100 is positioned on the outlet side 446 of the second portion 442, corresponding to the second cylinder bank 204 shown in FIG. 2, of engine 10.

Furthermore, the second PCV outlet vent 1100 extends through the cylinder head 200 from a top 430 to a bottom 432 and through the second engine block exterior sidewall 1002. In this way, the second PCV outlet vent 1100 may be integrated into the engine 10. The second PCV outlet vent 1100 further includes an outlet 1102 opening into the second cam chamber 1006. The periphery of the second cam chamber 1006 may at least be partially defined by the second cam cover 900. The second PCV outlet vent 1100 further includes an inlet 1104 opening into the crankcase 214. Thus, gas may be flowed from the crankcase 214 into the second PCV outlet vent 1100 and into the second cam chamber 1006. Gas may be flowed from the second cam chamber into the intake system 222, shown in FIG. 2. FIG. 11 also shows a cylinder 1106 which may be included in the second cylinder bank 204, shown in FIG. 2.

Figure 12:
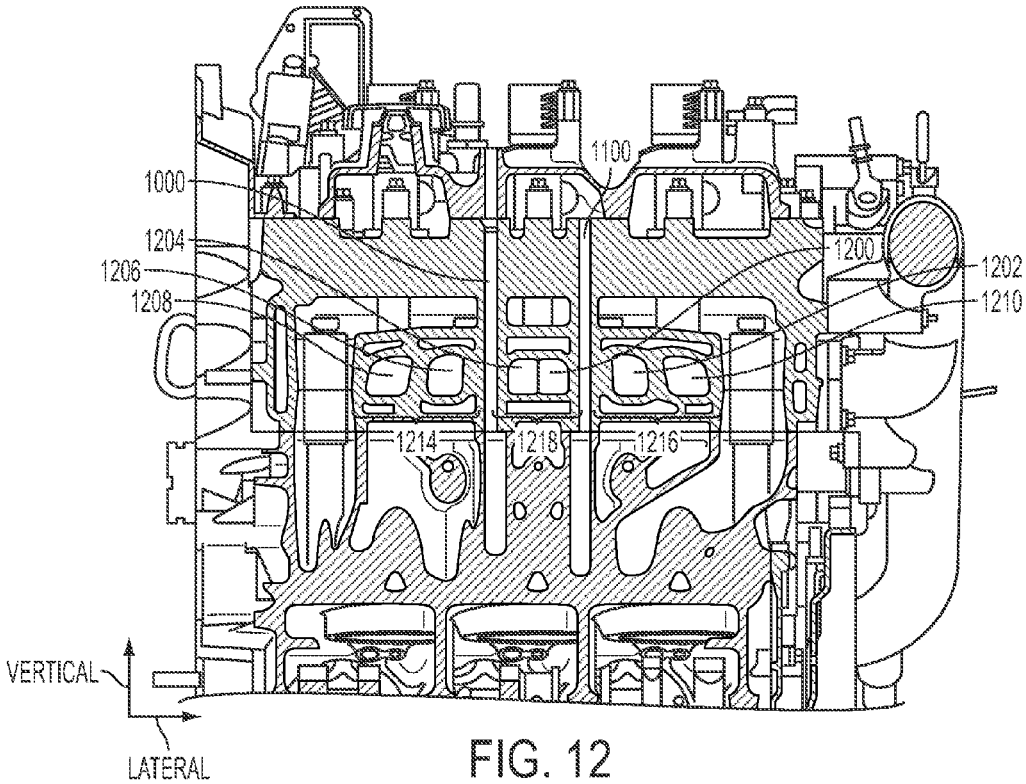
FIG. 12 shows a cross-sectional view of the first and second PCV outlet vents included in the PCV system, shown in FIG. 2.

FIG. 12 shows a cross-sectional view of the engine 10 and specifically the second PCV outlet vent 1100 and the first PCV outlet vent 1000. As shown, the second PCV outlet vent 1100 is positioned between exhaust gas runner 1200 and exhaust gas runner 1202 included in the second integrated exhaust manifold 232. The first PCV outlet vent 1000 is positioned between exhaust gas runner 1204 and exhaust gas runner 1206 included in second integrated exhaust manifold 232. The second integrated exhaust manifold 232 further includes exhaust gas runner 1208 and exhaust gas runner 1210. The exhaust gas runner 1206 and 1208 are included in an outer set of exhaust gas runner 1214. The exhaust gas runners 1202 and 1210 are included in another set of outer exhaust gas runners 1216 and the exhaust gas runner 1200 and 1204 are included in an inner set of exhaust gas runner 1218. The two sets of outer exhaust gas runners 1214 and 1216 as well as the inner set of exhaust gas runners 1218 are each fluidly coupled to a separate cylinder. Moreover, each exhaust gas runner is fluidly coupled to an exhaust valve in the corresponding cylinder. It will be appreciated that the second integrated exhaust manifold 232 may have a different configuration in other examples. For example, the second integrated exhaust manifold 232 may include only a single exhaust gas runner fluidly coupled to each cylinder or more than two exhaust gas runner fluidly coupled to each cylinder.

Figure 13:
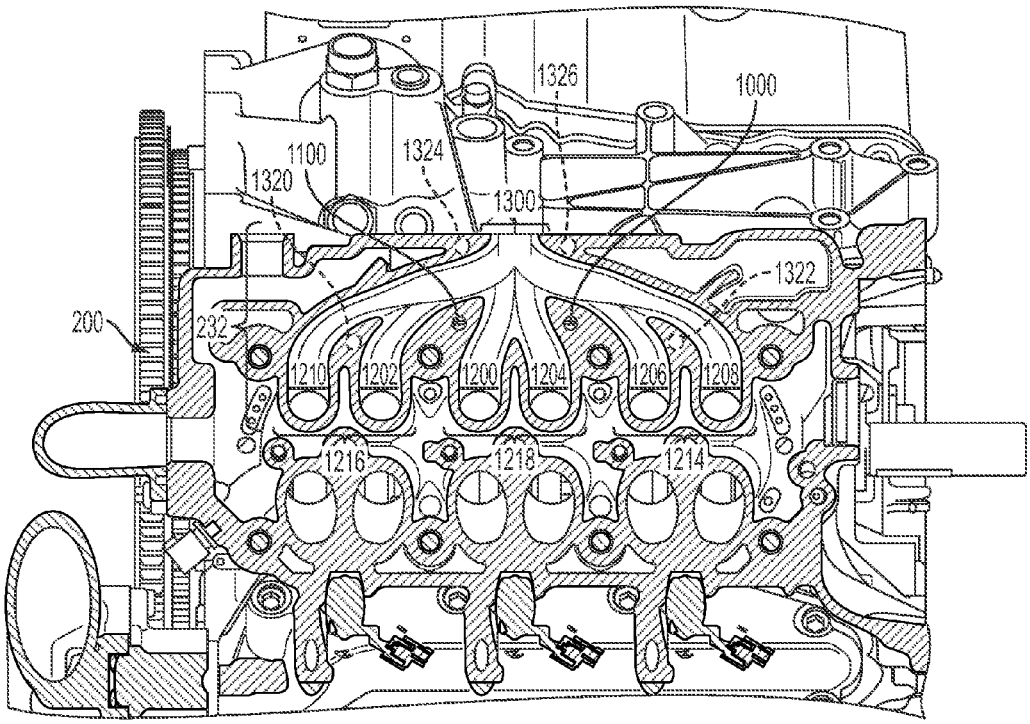
FIG. 13 shows a cross-sectional view of the first and second PCV outlet vents and a second integrated exhaust manifold included in the PCV system and engine shown in FIG. 2.

FIG. 13 shows another cross-sectional view of the engine 10 and specifically the second integrated exhaust manifold 232. The outer sets of exhaust gas runners 1214 and 1216 including exhaust gas runners (1202, 1206, 1208, and 1210) are shown. Additionally, the inner set of exhaust gas runners 1218 including exhaust gas runners (1200 and 1204), is shown. As shown, the first PCV outlet vent 1000 extends between exhaust gas runner 1204 and exhaust gas runner 1206. Exhaust gas runners 1204 and 1206 are fluidly coupled to separate cylinders in the engine 10. However, in other examples, the PCV outlet vent 1000 may extend between exhaust gas runners fluidly coupled to a single cylinder in the engine 10.

Furthermore, the second PCV outlet vent 1100 extends between exhaust gas runner 1200 and exhaust gas runner 1202. Exhaust gas runners 1200 and 1202 are fluidly coupled to separate cylinders in the engine 10. However, in other examples, the PCV outlet vent 1100 may extend between exhaust gas runners fluidly coupled to a single cylinder in the engine 10.

The outer sets of exhaust gas runners (1214 and 1216) as well as the inner set of exhaust gas runners 1218 may converge at a collector 1300. The collector 1300 may be coupled to the exhaust system 240, shown in FIG. 2. For example, the collector may be fluidly coupled to an exhaust passage, a turbine in a turbocharger, an emission control device, etc.

The PCV outlet vents (1000 and 1100) may provide cooling to the second integrated exhaust manifold 232 via the transfer of heat from the exhaust manifold to the gas in the PCV vents during certain operating conditions. In this way, heat may be removed from the second integrated exhaust manifold 232 and the cylinder head 200. As a result, the likelihood of thermal degradation of the cylinder head 200 and the second integrated exhaust manifold 232 is reduced. Moreover, the heat provided to the PCV outlet vents (1000 and 1100) reduces the condensation in the PCV vents.

In other examples, additional or alternate PCV outlet vents may be included in the engine 10. For example, an PCV outlet vent 1320 may be positioned between exhaust gas runners (1202 and 1210) and/or an PCV outlet vent 1322 may be positioned between exhaust gas runner (1206 and 1208). Furthermore, PCV outlet vents 1324 and/or 1326 may be positioned near the periphery of the cylinder head adjacent to the collector 1300. The PCV outlet vents 1320, 1322, 1324, and/or 1326 may extend from the top 430 of the cylinder head 200 to the bottom 432 of the cylinder head 200 and through the engine block 202 opening into crankcase 214, shown in FIG. 4. The PCV outlet vents 1320, 1322, 1324, and/or 1326 may also open into the second cam chamber 1006, shown in FIG. 10.

Figure 14:
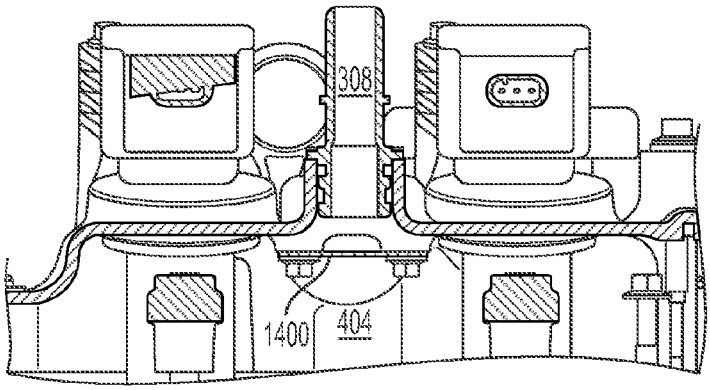
FIG. 14 shows a cross-sectional view of an intake port included in the first cam cover shown in FIG. 3

FIG. 14 shows a cross-sectional view of the intake port 308 opening into the first cam chamber 404. As previously discussed, the intake port 308 may be in fluidic communication with the intake system 222 upstream of the throttle 62, shown in FIG. 1. In one example, the intake port 308 may be in fluidic communication with the zip tube 42, shown in FIG. 1. However, in other examples, the intake port 308 may be in fluidic communication with the surrounding atmosphere. In this way, the intake port 308 may serve to fluidly couple the substantially sealed first cam chamber 404 with the intake system 222. As shown, a plate 1400 may be positioned in the first cam chamber 404 at a point below the intake port 308. The plate 1400 reduces the amount of oil that enters the intake port 308.

Figure 15:
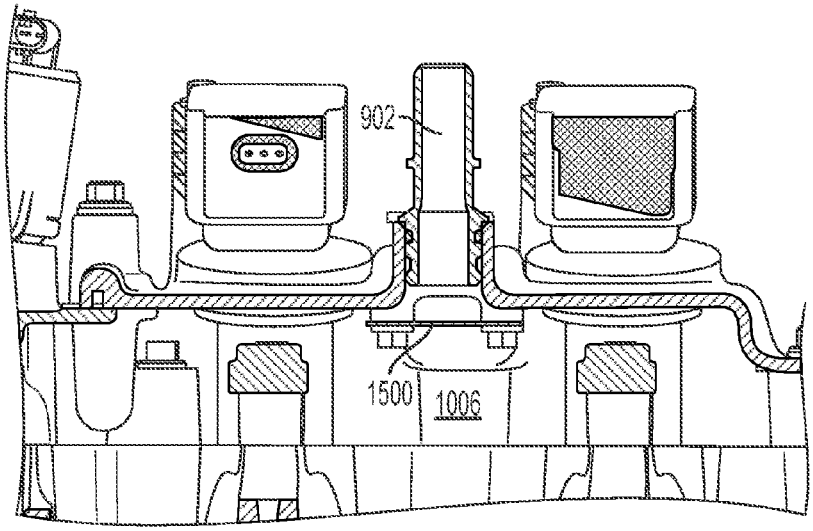
FIG. 15 shows a cross-sectional view of an outlet port included in the second cam cover shown in FIG. 9.

FIG. 15 shows a cross-sectional view of the outlet port 902 opening into the second cam chamber 1006. As previously discussed, the outlet port 902 may be in fluidic communication with the intake system 222 downstream of the throttle 62, shown in FIG. 1. In one example, the intake port 308 may be in fluidic communication with the intake manifold 44, shown in FIG. 1. In this way, the outlet port 902 may serve to fluidly couple the substantially sealed second cam chamber 1006 with the intake system 222. As shown, a plate 1500 may be positioned in the second cam chamber 1006 at a point below the outlet port 902. The plate 1500 reduces the amount of oil that enters the outlet port 902.

It will be appreciated that the cylinder head 200 and/or engine block 202 each may be formed in a single unitary casting. Furthermore, the first PCV intake vent 400, the second PCV intake vent 500, the first PCV outlet vent 1000, and/or the second PCV outlet vent 1100 may be formed in the casting or alternatively may be machined into the cylinder head and/or engine block after casting.

Figure 16:
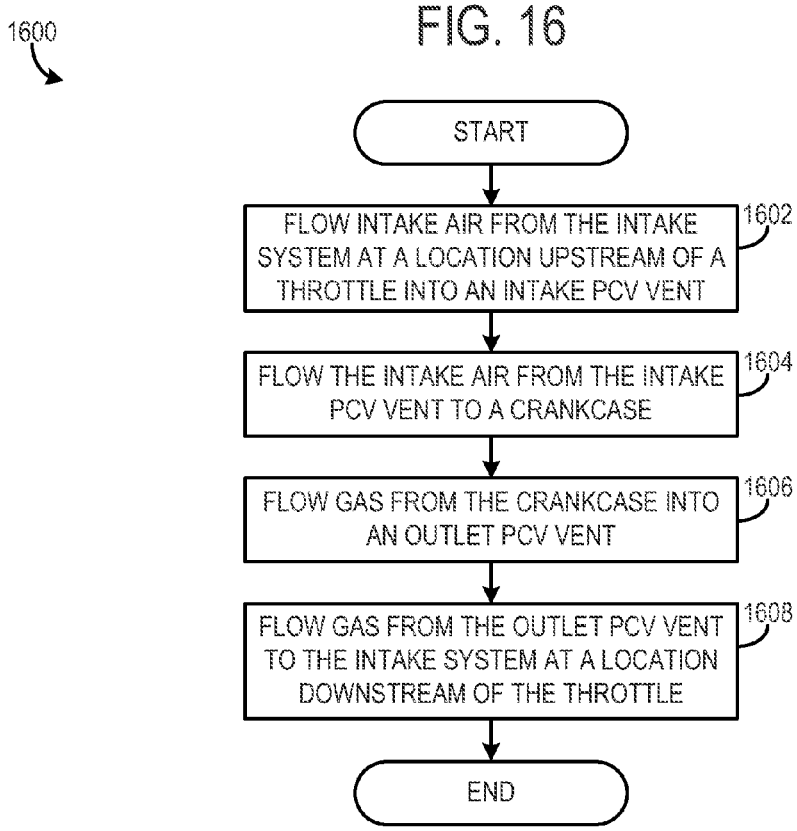
FIG. 16 shows a method for controlling a crankcase ventilation system.

FIG. 16 shows a method 1600 for operation of a PCV system in an engine. The method 1600 may be implemented via the engine 10 and engine components described above with regard to FIGS. 1-15 or alternatively may be implemented via other suitable systems and components.

At 1602, the method includes flowing intake air from the intake system at a location upstream of a throttle into a PCV intake vent. Next at 1604, the method includes flowing the intake air from the PCV intake vent to a crankcase. At 1606, the method includes flowing gas from the crankcase into a PCV outlet vent. At 1608, the method includes flowing gas from the PCV outlet vent to the intake system at a location downstream of the throttle.

It will be appreciated that the configurations and/or approaches described herein are exemplary in nature, and that these specific examples or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine comprising:

an engine block;

a cylinder head coupled to the engine block and including an integrated exhaust manifold with at least first and second exhaust gas runners in fluidic communication with at least one cylinder; and a pair of PCV vents positioned within an exterior cylinder head wall and bounding an exhaust collector, the pair of PCV vents extending from a bottom of the cylinder head to a top of the cylinder head.

2. The engine of claim 1, where the first exhaust gas runner is in fluid communication with a first cylinder and the second exhaust gas runner is in fluid communication with a second cylinder, where the first exhaust gas runner and the second exhaust gas runner lead from the at least one cylinder into the exhaust collector, and where at least one of the pair of PCV vents is further positioned within the exterior cylinder head wall where the exterior cylinder head wall intersects a wall of the integrated exhaust manifold.

3. The engine of claim 1, where the first and second exhaust gas runners are in fluid communication with a single cylinder, and further comprising a PCV vent positioned between the first and second exhaust gas runners.

4. The engine of claim 1, further comprising a second cylinder head and a second integrated exhaust manifold including third and fourth exhaust gas runners and a PCV vent extending through the second cylinder head between the third and fourth exhaust gas runners.

5. The engine of claim 4, where the pair of PCV vents are in fluid communication with an engine air intake system at a location downstream of a throttle.

6. The engine of claim 4, where the first exhaust gas runner is in fluid communication with a first cylinder and where the third exhaust gas runner is in fluid communication with a second cylinder, the first and second cylinders positioned at non-straight angles with regard to each other.

7. The engine of claim 5, where the pair of PCV vents extend through an exterior sidewall of the engine block.

8. The engine of claim 1, further comprising a sealed crankcase positioned below the cylinder head and at least partially enclosing a crankshaft, the pair of PCV vents including an outlet opening into the sealed crankcase and an inlet in fluid communication with an engine air intake system.

9. The engine of claim 1, where the pair of PCV outlet vents are positioned on an outlet side of the cylinder head spaced away from an inlet side of the cylinder head.

10. An engine comprising:

an engine block;

a cylinder head with an integrated exhaust manifold and first and second exhaust gas runners coupled to the engine block, the cylinder head including an exhaust side and an intake side, the exhaust side and the intake side separated via a center of a row of combustion chambers, the first and second exhaust gas runners in fluid communication with at least one cylinder; and a first PCV vent positioned within an exterior cylinder head wall on a first side of an exhaust collector on the exhaust side of the cylinder head and a second PCV vent positioned within the exterior cylinder head wall on a second side of the exhaust collector on the exhaust side of the cylinder head, said first and second PCV vents flowing fresh air from an intake conduit to a crankcase.

11. The engine of claim 10, where the first PCV vent extends through an exterior sidewall of the engine block, and further comprising a PCV vent positioned between two exhaust runners extending from a single cylinder.

12. The engine of claim 10, where the first and second exhaust gas runners converge into the exhaust collector, and where at least one of the pair of PCV vents is further positioned within the exterior cylinder head wall where the exterior cylinder head wall intersects a wall of the integrated exhaust manifold.

13. The engine of claim 10, where the cylinder head and the integrated exhaust manifold are cast via a single unitary casting.

14. The engine of claim 13, where the first PCV vent is cast in the single unitary casting.

15. The engine of claim 10, where the first exhaust gas runner is in fluid communication with a first cylinder and where the second exhaust gas runner is in fluid communication with a second cylinder.

16. An engine comprising:

an engine block;

first cylinder and second cylinder heads coupled to the engine block, the first cylinder head including a first integrated exhaust manifold including at least first and second exhaust gas runners entering a first exhaust collector, the second cylinder head including a second integrated exhaust manifold including third and fourth exhaust gas runners entering a second exhaust collector, the first and second exhaust gas runners in fluid communication with at least one cylinder and the third and fourth exhaust gas runners in fluid communication with at least one cylinder;

a pair of PCV outlet vents flowing blow-by gasses to an intake conduit and positioned within a length of an exterior cylinder head wall of the first cylinder head on first and second sides of the first exhaust collector and extending from a bottom of the first cylinder head to a top of the first cylinder head; and a pair of PCV intake vents positioned along a length of an exterior cylinder head wall of the second cylinder head on first and second sides of the second exhaust collector and extending from a bottom of the second cylinder head to a top of the second cylinder head.

17. The engine of claim 16, where the pair of PCV intake and outlet vents are positioned in separate cylinder banks, and where at least one of the pair of PCV inlet vents is further positioned within the exterior cylinder head wall where the exterior cylinder head wall intersects a wall of the integrated exhaust manifold.

18. The engine of claim 16, where each of the first, second, third, and fourth exhaust gas runners are in fluid communication with separate cylinders.

19. The engine of claim 16, where the pair of PCV outlet vents extend through an external sidewall of the engine block.

* * * * *